US006890063B2

(12) United States Patent
Kim

(10) Patent No.: US 6,890,063 B2
(45) Date of Patent: May 10, 2005

(54) INK-JET PRINTHEAD AND METHOD OF MANUFACTURING THE INK-JET PRINTHEAD

(75) Inventor: Jin-hyun Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 109 days.

(21) Appl. No.: 10/626,884

(22) Filed: Jul. 25, 2003

(65) Prior Publication Data

US 2004/0233254 A1 Nov. 25, 2004

(30) Foreign Application Priority Data

Oct. 11, 2002 (KR) ..... 10-2002-0062115

(51) Int. Cl.[7] ..... B41J 2/05
(52) U.S. Cl. ..... 347/56
(58) Field of Search ..... 347/56, 54, 71, 347/67, 68, 59, 58, 50, 40, 20, 9, 5, 7, 1, 62, 63, 84, 85, 86

(56) References Cited

U.S. PATENT DOCUMENTS 4,882,595 A 11/1989 Trueba et al.
5,912,685 A 6/1999 Raman
6,806,108 B2 * 10/2004 Park et al. ..... 438/21
2004/0000429 A1 * 1/2004 Furusawa et al. ..... 174/264

FOREIGN PATENT DOCUMENTS

JP 2002-254662 9/2002

OTHER PUBLICATIONS

Notice to Submit Response mailed Jul. 31, 2004 from the Korean Patent Office in the corresponding Korean Patent Application.

* cited by examiner

*Primary Examiner*—Raquel Yvette Gordon
(74) *Attorney, Agent, or Firm*—Staas & Halsey LLP

(57) ABSTRACT

An ink-jet printhead and a method of manufacturing the same includes a substrate in which a manifold supplying ink is formed, a nozzle plate which is formed to be spaced-apart from the substrate by a predetermined gap and in which a nozzle through which ink is ejected is formed, a barrier wall which seals a space formed between the substrate and the nozzle plate to define an ink chamber filled with the ink to be ejected, an ink channel connected to the ink chamber, and an ink feed hole connecting the ink channel to the manifold, and an insulating layer which is formed on the substrate to form lower walls of the ink chamber, the ink channel, and the ink feed hole, where a heater generating bubbles by heating the ink filled in the ink chamber is formed on the lower walls of the ink chamber. The ink feed hole includes a plurality of through holes which perforate the insulating layer and through which the ink channel is connected to the manifold, and a plurality of posts which are formed on the insulating layer and support the nozzle plate.

19 Claims, 13 Drawing Sheets

INK-JET PRINTHEAD AND METHOD OF MANUFACTURING THE INK-JET PRINTHEAD

CROSS-REFERENCE TO RELATED APPLICATIONS

This application claims the benefit of Korean Application No. 2002-62115, filed Oct. 11, 2002, in the Korean Intellectual Property Office, the disclosure of which is incorporated herein by reference.

BACKGROUND OF THE INVENTION

1. Field of the Invention

The present invention relates to an ink-jet printhead and a method of manufacturing the ink-jet printhead, and more particularly, to an ink-jet printhead having an improved structure preventing deformation of a nozzle plate, filtering out impurities remaining in ink, and preventing a head chip from being damaged by cracks, and a method of manufacturing the ink-jet printhead.

2. Description of the Related Art

In general, ink-jet printheads are devices for printing a predetermined color image by ejecting small volumes of droplets of printing ink at desired positions on a recording sheet. These ink-jet printheads are divided by two driving methods according to an ink ejection mechanism: ink-jet printheads using a thermal driving method of ejecting ink droplets by an expansion force of bubbles generated in ink by a heat source, and ink-jet printheads using a piezoelectric driving method of ejecting the ink droplets by a pressure applied to the ink due to deformation of a piezoelectric body.

Hereinafter, the ink ejection mechanism in the thermal ink-jet printheads will be described in greater detail. When current having a pulse shape flows through a heater formed of a resistance heating material, heat is generated in the heater, and the ink adjacent to the heater is instantaneously heated to about 300° C. As such, ink is boiled, and the bubbles are generated in the ink, expand, and apply the pressure to an inside of an ink chamber filled with the ink. As a result, the ink in the vicinity of a nozzle is ejected in a droplet shape through nozzles of the ink chamber.

Here, the thermal driving method includes a top-shooting method, a side-shooting method, and a back-shooting method according to a growth direction of the bubbles and an ejection direction of the ink droplets.

The top-shooting method is a method in which the growth direction of the bubbles is the same as the ejection direction of the ink droplets. The side-shooting method is a method in which the growth direction of the bubbles is perpendicular to the ejection direction of the ink droplets. The back-shooting method is a method in which the growth direction of the bubbles is opposite to the ejection direction of the ink droplets.

The ink-jet printheads using the thermal driving method should satisfy the following requirements. First, manufacturing of the ink-jet printheads has to be simple, costs have to be low, and mass a production thereof has to be possible. Second, in order to obtain a high-quality image, a crosstalk between adjacent nozzles has to be suppressed and an interval therebetween has to be narrow, that is, in order to increase the number of dots per inch (DPI), a plurality of nozzles has to be arranged with narrow intervals therebetween. Third, in order to perform a high-speed printing operation, a period in which the ink chamber is refilled with ink after the ink is ejected from the ink chamber, has to be as short as possible, and heated ink has to be quickly cooled such that a driving frequency can increase.

FIGS. 1A and 1B show a conventional ink-jet printhead using a thermal driving method. FIG. 1A is a sectional perspective view of a structure of the conventional ink-jet printhead, and FIG. 1B is a cross-sectional view illustrating operations of ejecting ink droplets in the conventional ink-jet printhead, disclosed in U.S. Pat. No. 4,882,595. Referring to FIGS. 1A and 1B, the conventional ink-jet printhead using the thermal driving method includes a substrate 10, a barrier wall 14 which is formed on the substrate 10 and defines an ink chamber 26 and an ink channel 24, a heater 12 installed under the ink chamber 26, and a nozzle plate 18 having a nozzle 16 through which ink droplets 29' are ejected. When a current having a pulse shape is supplied to the heater 12 and heat is generated from the heater 12, ink 29 filled in the ink chamber 26 is heated, thereby generating bubbles 28 in the ink 29. The bubbles 28 expand continuously such that a pressure is applied to the ink 29 filled in the ink chamber 26 and the ink droplets 29' are ejected through the nozzle 16 to an outside of the ink-jet printhead. Subsequently, the ink 29 is supplied to the ink chamber 26 through the ink channel 24 from a manifold 22, and the ink chamber 26 is refilled with the ink 29.

However, in the above conventional ink-jet printhead, the ink channel 24 or the nozzle 16 is clogged with impurities remaining in the ink 29 such that the ink 29 is not well supplied to the ink channel 24 or the nozzle 16. Also, cracks occur at both sides of a surface of the substrate 10 in which the manifold 22 is formed, such that a head chip of the ink-jet printhead may be damaged. Meanwhile, since the ink-jet printhead as described above is manufactured by attaching the nozzle plate 18 to the substrate 10, a process of manufacturing the ink-jet printhead becomes complicated, and a misalignment may occur during the attaching process.

FIG. 2 shows another conventional ink-jet printhead proposed to solve the above problems and is a sectional perspective view of a structure of the conventional ink-jet printhead disclosed in U.S. Pat. No. 5,912,685. Referring to FIG. 2, the ink-jet printhead includes a substrate 1, a barrier wall 2 which is formed on the substrate 1, a barrier layer 3 which defines an ink channel 7 together with the barrier wall 2, a heater 4 installed under an ink chamber 9, and a nozzle plate 5 in which a nozzle 6 is formed. In the above structure, ink is sent into the ink chamber 9 through the ink channel 7 formed by the barrier wall 2 and the barrier layer 3 from a manifold 8. Thus, ink of which impurities are filtered out is supplied to the ink chamber 9.

However, in the above ink-jet printhead, when a large amount of the impurities remain in the ink, the ink channel 7 is clogged with the impurities such that the ink cannot be supplied any longer to the ink chamber 9. Meanwhile, as described above, cracks may occur at both sides of a surface of the substrate 1 in which the manifold 8 is formed, and a process of manufacturing the ink-jet printhead becomes complicated.

SUMMARY OF THE INVENTION

The present invention provides an ink-jet printhead having an improved structure by which deformation of a nozzle plate is prevented, in which impurities remaining in ink are filtered out, and in which a head chip is prevented from being damaged by cracks, and a method of manufacturing the ink-jet printhead.

Additional aspects and advantages of the invention will be set forth in part in the description which follows and, in part, will be obvious from the description, or may be learned by practice of the invention.

Accordingly, according to an aspect of the present invention, an ink-jet printhead includes a substrate in which a manifold supplying ink is formed, a nozzle plate which is formed to be spaced-apart from the substrate by a predetermined gap and in which a nozzle through which the ink is ejected is formed, a barrier wall which seals a space formed between the substrate and the nozzle plate to define an ink chamber filled with the ink to be ejected, an ink channel connected to the ink chamber, and an ink feed hole connecting the ink channel to the manifold, and an insulating layer which is formed on the substrate and forms lower walls of the ink chamber, the ink channel, and the ink feed hole, where a heater generating bubbles by heating the ink filled in the ink chamber is formed on the lower walls of the ink chamber. The ink feed hole includes a plurality of through holes which perforate the insulating layer and through which the ink channel is connected to the manifold, and a plurality of posts which are formed on the insulating layer and support the nozzle plate.

According to another aspect of the present invention, the through hole is formed to have the same depth as the insulating layer, or to be deeper than the insulating layer by etching the insulating layer and a surface of the substrate.

According to another aspect of the present invention, the barrier wall and the posts are formed of polyimide.

In the ink-jet printhead according to the present invention, the nozzle plate is prevented from being deformed downward by the posts formed in the insulating layer, and the ink of which impurities are filtered out through the through hole formed in the insulating layer can be supplied to the ink chamber. In addition, a damage of a head chip caused by cracks which occur on the surface of the substrate, can be prevented.

According to another aspect of the present invention, a method of manufacturing an ink-jet printhead includes forming an insulating layer on a surface of a substrate and forming a heater on the insulating layer, forming a plurality of grooves having a predetermined depth in the insulating layer, forming a barrier wall which defines an ink chamber, an ink channel, and an ink feed hole and forming a plurality of posts on the insulating layer in which the grooves are formed, coating a predetermined material on the insulating layer on which the barrier wall and the posts are formed, and plaining top surfaces of the barrier wall and the posts, forming a nozzle plate on the top surfaces of the barrier wall and the posts, forming a nozzle through which the predetermined material is exposed in the nozzle plate, forming a manifold through which the predetermined material filled in the grooves is exposed by etching a back surface of the substrate, and forming the ink chamber, the ink channel, and the ink feed hole by removing the predetermined material exposed through the nozzle and the manifold. Here, it is possible that the forming of the barrier wall includes forming a predetermined material layer on the insulating layer and patterning the material layer to form the barrier wall and the posts.

It is possible that the material layer is formed of polyimide.

In the method of manufacturing the ink-jet printhead according to another aspect of the present invention, the ink-jet printhead is monolithically manufactured such that a process of manufacturing the ink-jet printhead can be simplified and a misalignment which may occur during a process of attaching the nozzle plate to the substrate can be prevented.

According to another aspect of the present invention, an ink-jet printhead includes a substrate having a manifold supplying ink, a nozzle plate having a nozzle, a barrier wall formed between the substrate and the nozzle plate to form an ink chamber communicating with the manifold and the nozzle, and a plurality of posts disposed in the ink chamber, formed between the substrate and the nozzle plate, and spaced-apart from each other to support the nozzle plate with respect to the substrate.

According to another aspect of the present invention, an ink-jet printhead includes a substrate having a manifold supplying ink, a nozzle plate having a nozzle, a barrier wall formed between the substrate and the nozzle plate to form an ink chamber and an ink feed hole portion communicating with corresponding ones of the nozzle and the manifold, and a plurality of posts disposed in the ink chamber, formed between the substrate and the nozzle plate, and spaced-apart from the barrier wall to support the nozzle plate with respect to the substrate.

According to another aspect of the present invention, an ink-jet printhead includes a substrate having a manifold supplying ink, an insulation layer formed on a surface of the substrate having at least one through hole communicating with the manifold, a nozzle plate having first and second nozzles, a barrier wall formed between the insulation layer and the nozzle plate to form first and second ink chambers communicating with corresponding ones of the first and second nozzles of the nozzle plate, an ink feed hole portion communicating with the through hole, and first and second ink channels disposed between the ink feed hole portion and corresponding ones of the ink chambers, with the insulation layer and the nozzle plate, and a post disposed in the ink feed hole portion, formed between the insulation layer and the nozzle plate, and spaced-apart from the barrier wall to support the nozzle plate with respect to the substrate.

According to another aspect of the present invention, a method of manufacturing a printhead includes forming a manifold on a substrate to supply ink, forming a nozzle on a nozzle plate, forming a barrier wall between the substrate and the nozzle plate to form an ink chamber communicating with the manifold and the nozzle, and removing a portion of the barrier wall to form a plurality of posts in the ink chamber, the posts formed between the substrate and the nozzle plate and spaced-apart from each other to support the nozzle plate with respect to the substrate.

According to another aspect of the present invention, a method of manufacturing a printhead includes forming a manifold on a substrate to supply ink, forming a nozzle on a nozzle plate, forming a barrier wall between the substrate and the nozzle plate to form an ink chamber and an ink feed hole portion communicating with corresponding ones of the nozzle and the manifold, and removing a portion of the barrier wall to form a plurality of posts in the ink chamber, the posts formed between the substrate and the nozzle plate and spaced-apart from the barrier wall to support the nozzle plate with respect to the substrate.

According to another aspect of the present invention, a method of manufacturing a printhead includes forming a manifold on a substrate to supply ink, forming an insulation layer on a surface of the substrate, forming at least one through hole communicating with the manifold on the insulation layer, causing a nozzle plate to have first and second nozzles, forming a barrier wall between the insulation layer and the nozzle plate to define first and second ink chambers communicating with corresponding ones of the first and second nozzles of the nozzle plate, an ink feed hole portion communicating with the through hole, and first and second ink channels disposed between the ink feed hole portion and corresponding ones of the ink chambers, with the insulation layer and the nozzle plate, and forming a post disposed in the ink feed hole portion, formed between the insulation layer and the nozzle plate, and spaced-apart from the barrier wall to support the nozzle plate with respect to the substrate.

BRIEF DESCRIPTION OF THE DRAWINGS

These and other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1A:
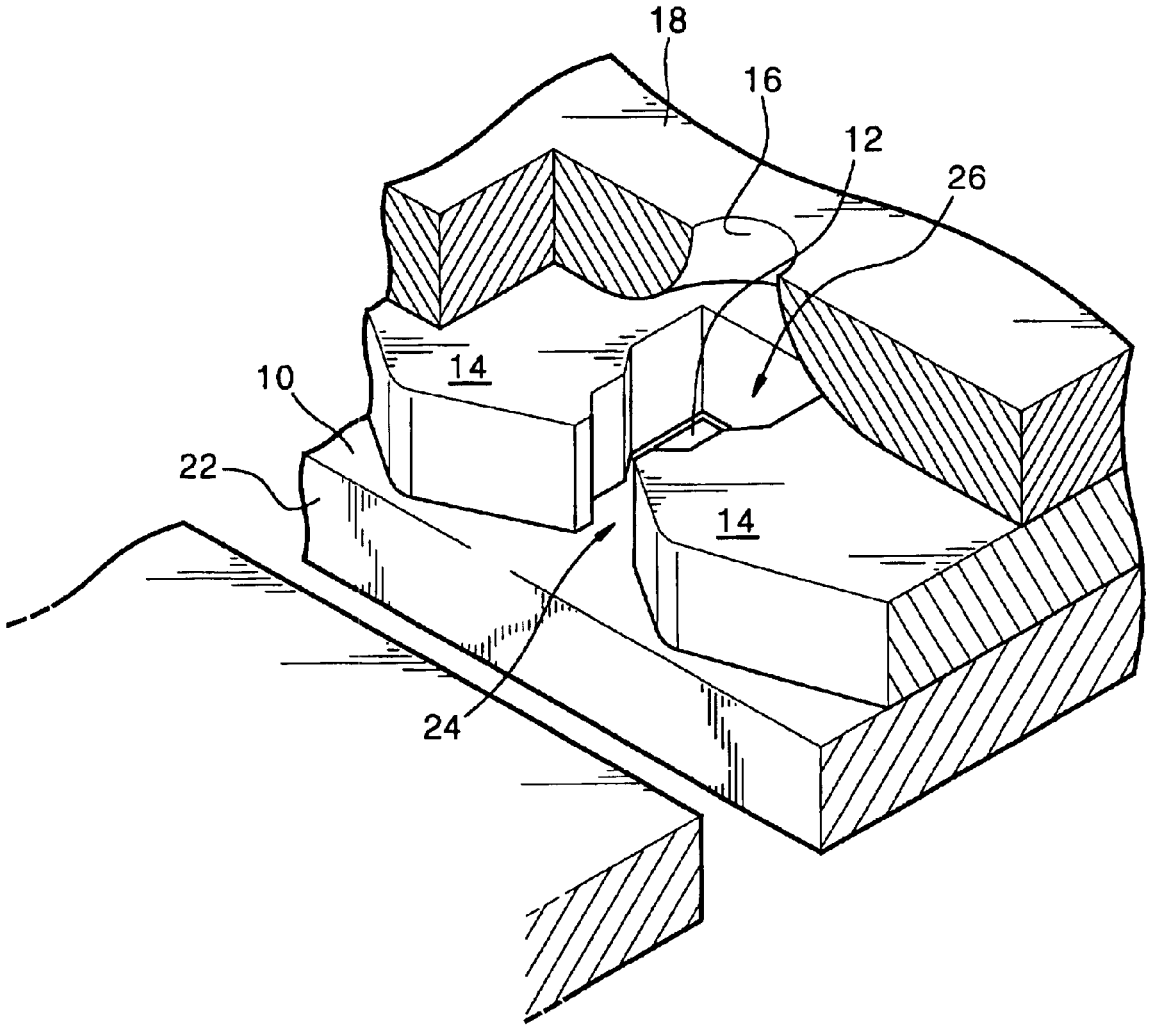
FIG. 1A (PRIOR ART)
FIGS. 1A and 1B show a sectional perspective view of a structure of a conventional ink-jet printhead and a cross-sectional view illustrating an operation of ejecting ink droplets in the conventional ink-jet printhead of FIG. 1A, respectively.
Figure 1B:
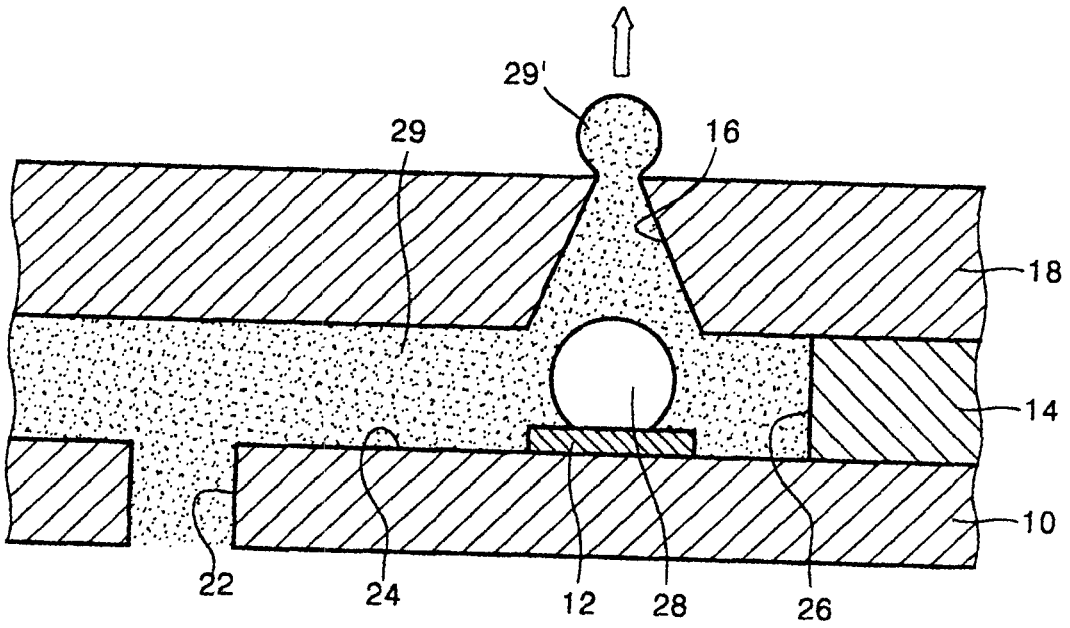
FIG. 1B (PRIOR ART)
Figure 2:
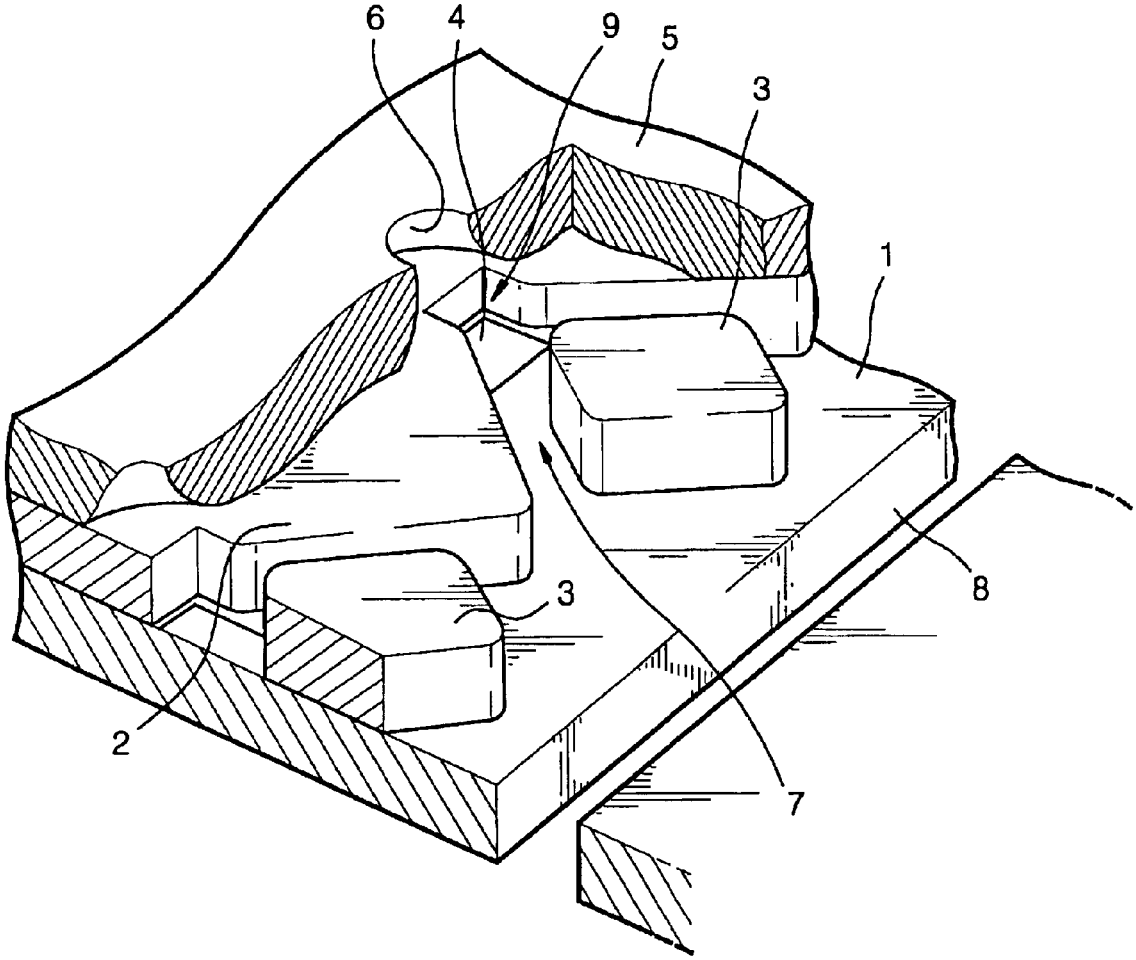
FIG. 2 (PRIOR ART)
FIG. 2 is a sectional perspective view of a structure of another conventional ink-jet printhead.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Hereinafter, the present invention will be described in detail by describing preferred embodiments of the invention with reference to the accompanying drawings. This invention may, however, be embodied in many different forms and should not be construed as being limited to the embodiments set forth herein. The same reference numerals denote elements having the same functions, and the size and thickness of an element may be exaggerated for clarity of explanation. It will be understood that when a layer is referred to as being on another layer or on a substrate, it can be directly on the other layer or on the substrate, or intervening layers may also be present.

Figure 3:
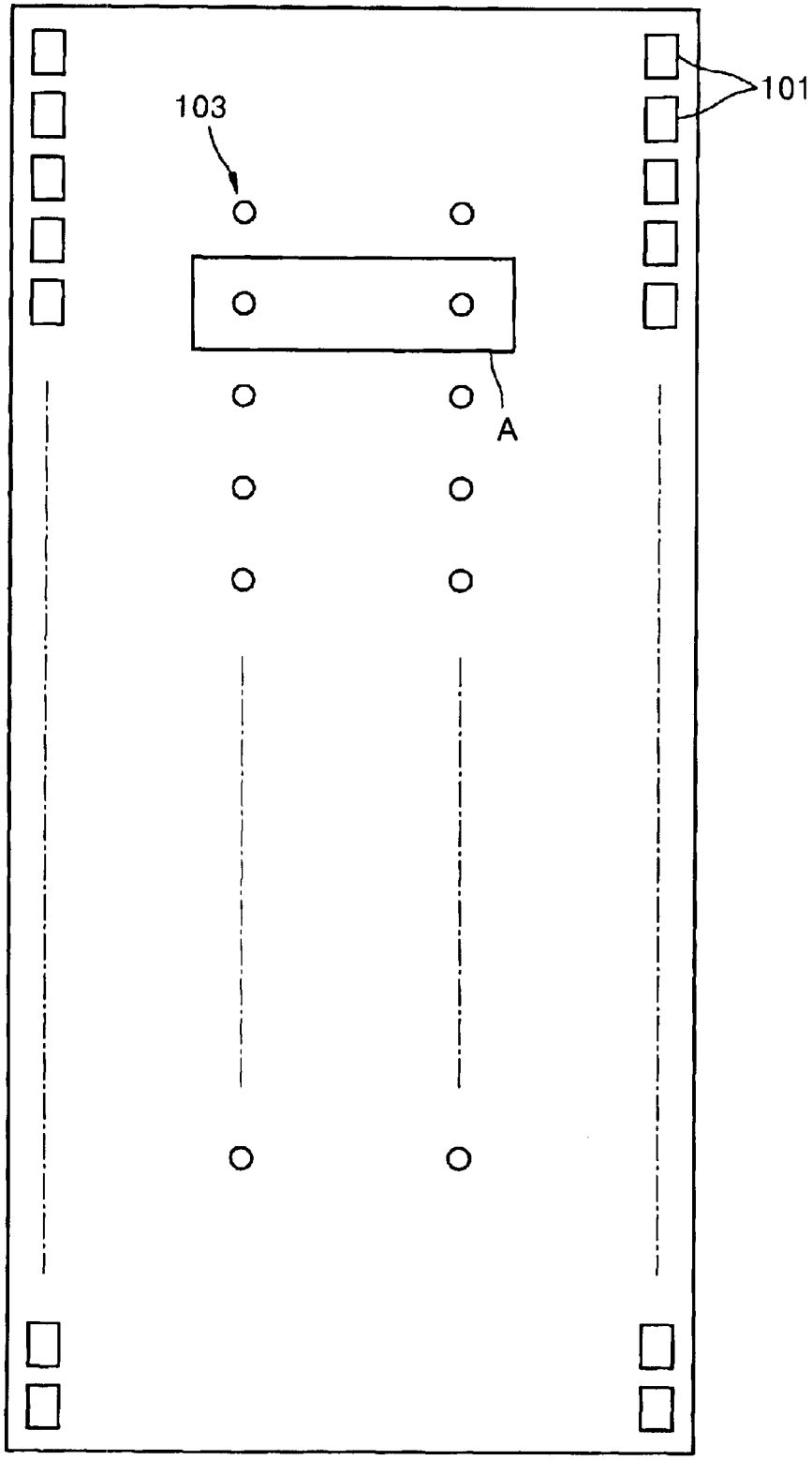
FIG. 3 is a schematic plan view illustrating an ink-jet printhead according to an embodiment of the present invention.

FIG. 3 is a schematic plan view illustrating an ink-jet printhead according to an embodiment of the present invention. Referring to FIG. 3, ink ejection units 103 are arranged in two rows, and bonding pads 101 are electrically connected to corresponding ones of the ink ejection units 103. In FIG. 3, although the ink ejection units 103 are arranged in two rows, the ink ejection units 103 may be arranged in one row or three or more rows so as to improve a printing resolution.

Figure 4:
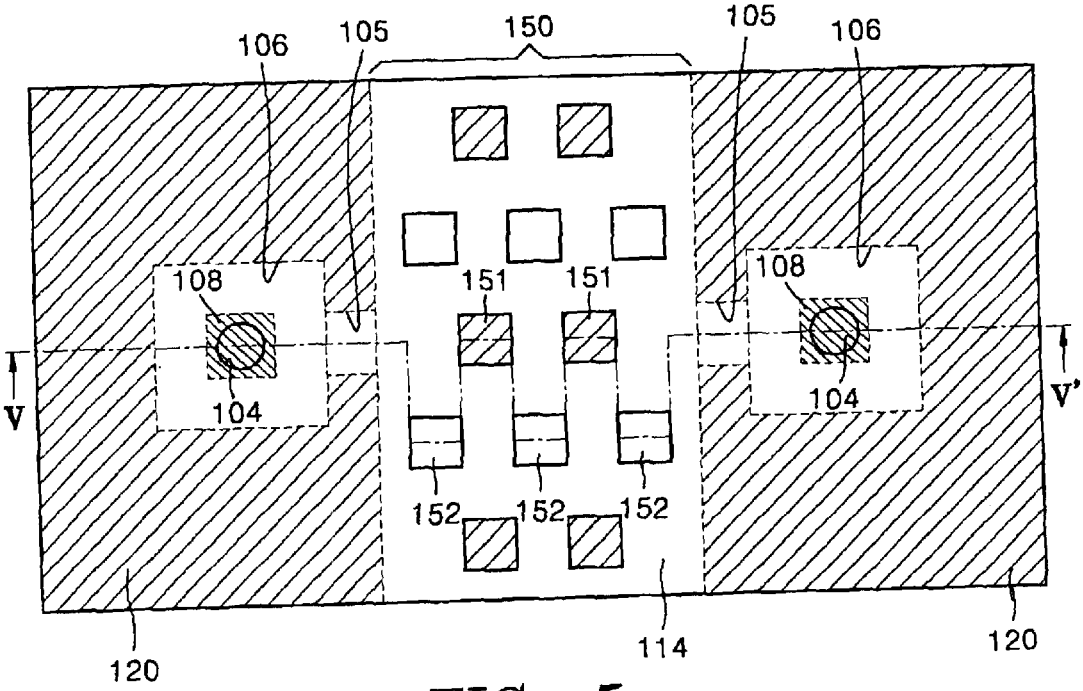
FIG. 4 is an enlarged plan view of portion A shown in FIG. 3.
Figure 5:
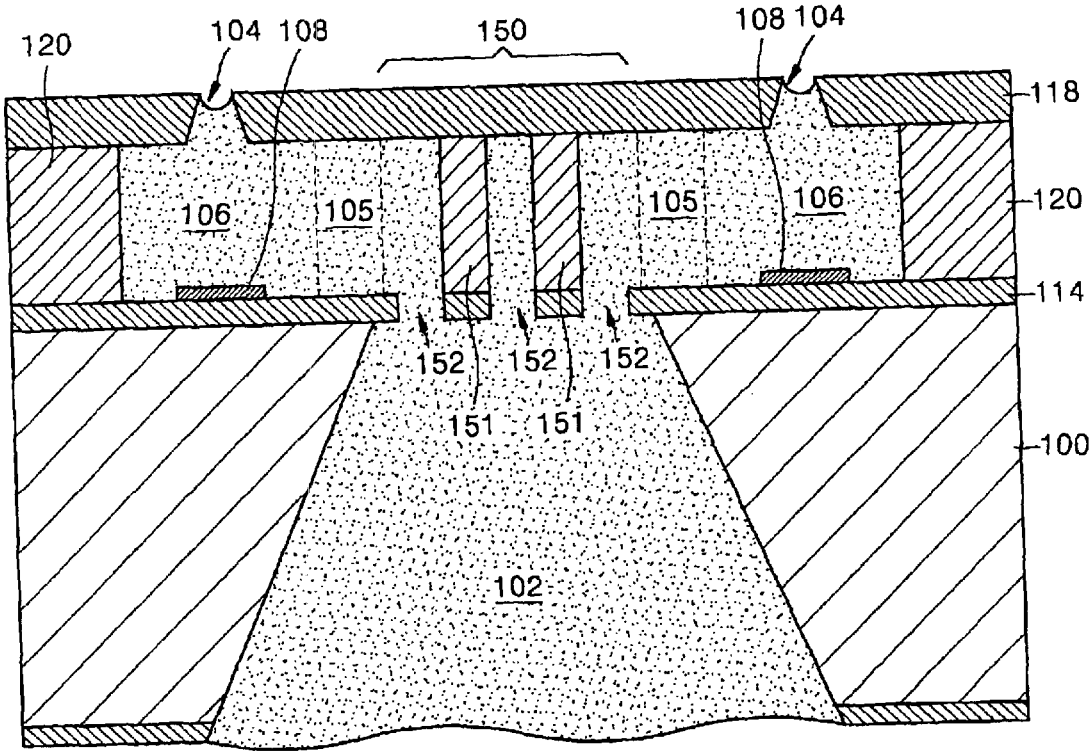
FIG. 5 is a cross-sectional view of the ink-jet printhead taken along line V–V' of FIG. 4.

FIG. 4 is an enlarged plan view of a portion A shown in FIG. 3, and FIG. 5 is a cross-sectional view illustrating a vertical structure of the ink-jet printhead taken along line V–V' of FIG. 4. Referring to FIGS. 4 and 5, the ink-jet printhead includes a substrate 100 in which a manifold 102 is formed, a nozzle plate 118 formed to be spaced-apart from the substrate 100 by a gap, a barrier wall 120 which is interposed between the substrate 100 and the nozzle plate 118 to define an ink channel 105 and an ink feed hole 150, and an insulating layer 114 formed on a surface of the substrate 100.

First, a silicon substrate that is widely used to manufacture integrated circuits (ICs) is used for the substrate 100. The manifold 102 to be connected to an ink reservoir (not shown) in which ink is stored, is formed to be perpendicular to the surface of the substrate 100.

The nozzle plate 118 is formed to be spaced-apart from the substrate 100 by the gap and forms upper walls of the ink chamber 106, the ink channel 105, and the ink feed hole 150. A nozzle 104 through which the ink is ejected is formed in the nozzle plate 118 to correspond to a center of the ink chamber 106.

The barrier wall 120 seals a space formed between the substrate 100 and the nozzle plate 118 to define the ink chamber 106, the ink channel 105, and the ink feed hole 150. It is possible that the barrier wall 120 is formed of photosensitive polyimide.

The ink to be ejected is filled in the ink chamber 106, and the ink is supplied from the manifold 102. Meanwhile, an ink passage which connects the manifold 102 to the ink chamber 106, is formed between the manifold 102 and the ink chamber 106. The ink passage includes the ink channel 105 and the ink feed hole 150. The ink channel 105 is connected to the ink chamber 106 and is formed on the same plane as the ink chamber 106. The ink feed hole 150 connects the ink channel 105 to the manifold 102 and is formed on the same plane as the ink chamber 106 and the ink channel 105.

The insulating layer 114 is formed on the surface of the substrate 100 and forms lower walls of the ink chamber 106, the ink channel 105, and the ink feed hole 150. It is possible that the insulating layer 114 is formed of a silicon oxide layer or tetraethylorthosilicate (TEOS) oxide layer.

A heater 108 which generates bubbles by heating the ink filled in the ink chamber 106, is formed on the insulating layer 114 to correspond to a center of the ink chamber 106. The heater 108 is formed of a resistance heating material, such as an impurity-doped polysilicon layer or a tantalum-aluminum alloy layer. Meanwhile, an electrode (not shown) supplying current having a pulse shape is connected to the heater 108. The electrode is electrically connected to bonding pads (101 of FIG. 3). The electrode is formed of the same material as the bonding pads (101 of FIG. 3), for example, metals, such as aluminum or aluminum alloy. Meanwhile, although not shown, a plurality of passiavation layers may be formed on the insulating layer 114.

Figure 6:
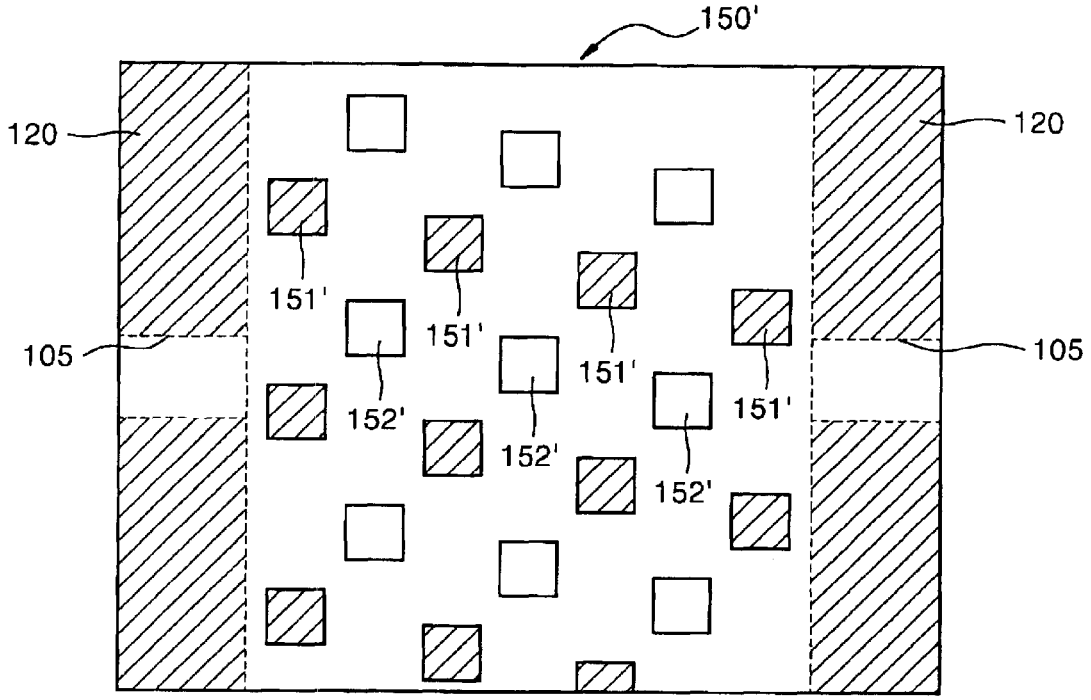
FIG. 6 is a plan view illustrating an ink feed hole of the ink-jet printhead shown in FIG. 4.

Meanwhile, the ink feed hole 150 which connects the manifold 102 to the ink channel 105, includes a plurality of through holes 152 and a plurality of posts 151 formed on the insulating layer 114. The through hole 152 is formed in the insulating layer 114 formed on the surface of the substrate 100 so that the ink enters the ink channel 105 from the manifold 102. Here, the through hole 152 is formed to the same depth as the thickness of the insulating layer 114. As such, the ink in the manifold 102 enters the ink channel 105 after the impurities are filtered out through the through holes 152. Meanwhile, the posts 151 are formed on the insulating layer 114. In this case, a top surface of each of the posts 151 contacts a lower surface of the nozzle plate 118 so as to support the nozzle plate 118. As a result, the nozzle plate 118 is not deformed downward. Meanwhile, the number or arrangement of the through holes 152 and the posts 151 may vary so as to optimize ink ejection characteristics. As a modification example, an ink feed hole 150' including through holes 152' and posts 151' which are arranged in a manner different from that of FIG. 4, are shown in FIG. 6.

Figure 7:
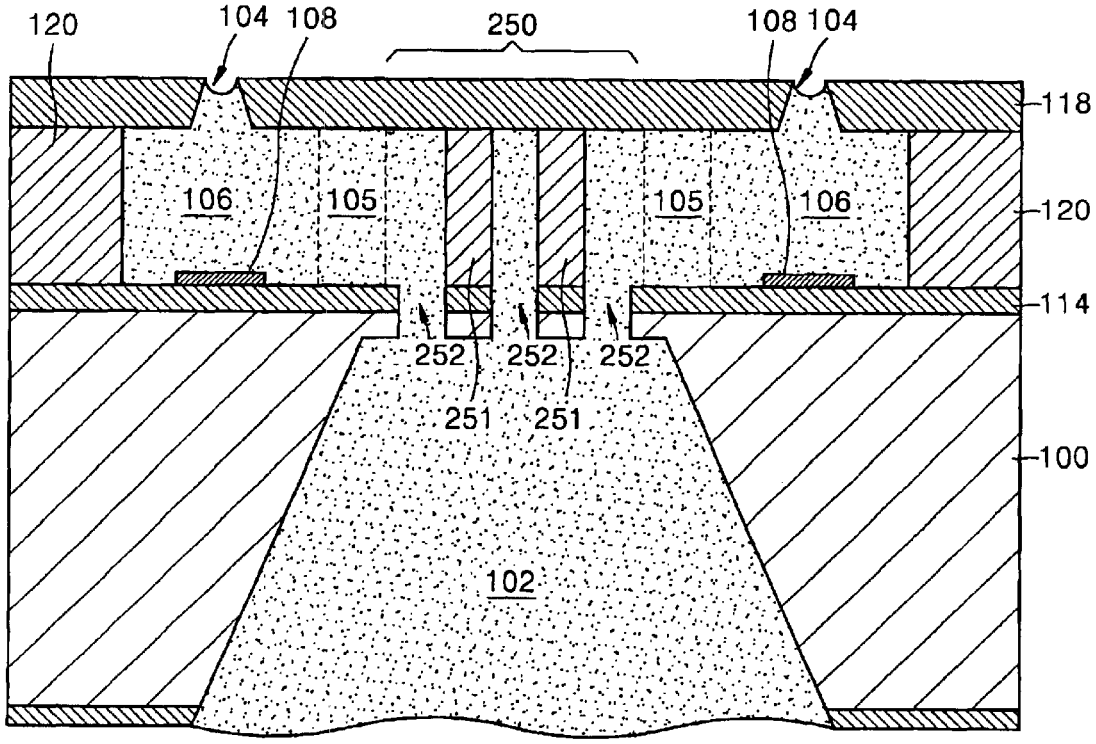
FIG. 7 is a cross-sectional view illustrating an ink-jet printhead according to another embodiment of the present invention.

FIG. 7 is a cross-sectional view illustrating of an ink-jet printhead according to another embodiment of the present invention. Referring to FIG. 7, an ink feed hole 250 includes a plurality of through holes 252 and a plurality of posts 251. Here, the through holes 252 are formed to be deeper than the insulating layer 114 by etching a surface of the insulating layer 114 and the surface of the substrate 100. Thus, cracks which may occur on the surface of the substrate 100, can be more effectively prevented.

In the above structure, when a current signal having a pulse shape is supplied to the heater 108 from a circuit (not shown) embedded in a head chip in a state where the ink is filled in the ink chamber 106, heat is generated in the heater 108, and thus, the ink on the heater 108 is heated. Next, if a temperature of the ink on the heater 108 is about 300° C., the ink is boiled, and bubbles are generated in the ink. Thus, due to the bubbles in a high-pressure gas state, ambient ink in a liquid state is pushed and expanded. Due to an expansion force of the bubbles, the ink in the ink chamber 106 is ejected through the nozzle 104 to an outside of the ink-jet printhead. Next, when the applied current is cut off, the ink in the ink chamber 106 is cooled, and the bubbles contract and disappear. In this case, the ink of which impurities are filtered out through the ink feed holes 150, 150', and 250 and the ink channel 105 from the manifold 102 reenters the ink chamber 106.

As described above, in the ink-jet printhead according to the present invention, the ink of which impurities are filtered out through the plurality of through holes 152, 152', and 252 is supplied to the ink chamber 106, and simultaneously, the cracks which may occur on the surface of the substrate 100, can be prevented, and thus, damage of the head chip can be reduced. Also, the posts 151, 151', and 251 which support the nozzle plate 118 are formed on the insulating layer 114 such that the deformation of the nozzle plate 118 can be prevented and the impurities remaining in the ink can be filtered out once again.

Hereinafter, a method of manufacturing the ink-jet printhead according to the present invention will be described.

FIGS. 8 through 16 are cross-sectional views illustrating a method of manufacturing the ink-jet printhead shown in FIG. 5.

Figure 8:
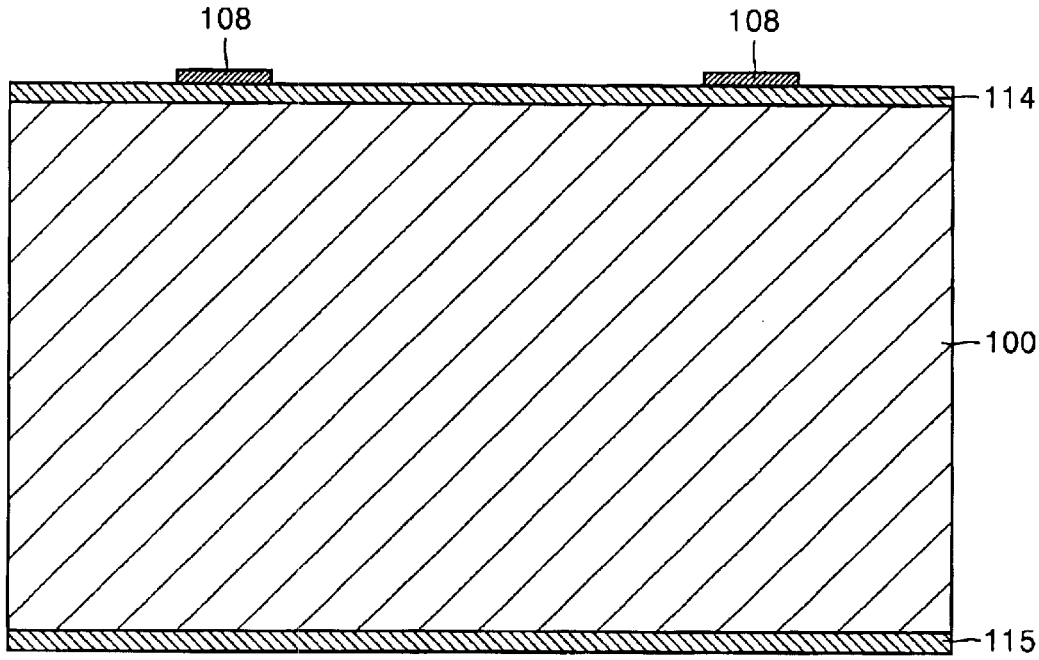
FIGS. 8 through 16 are cross-sectional views illustrating a method of manufacturing the ink-jet printhead shown in FIG. 5.

FIG. 8 illustrates a case where the insulating layer 114 is formed on the surface of the substrate 100 and the heater 108 is then formed on the insulating layer 114. Referring to FIG. 8, in the present embodiment, a silicon substrate having the thickness of about 500 $\mu$m is used for the substrate 100. This is because a silicon wafer that is widely used to manufacture semiconductor devices can be used and thus is effective in mass production.

Subsequently, the insulating layer 114 is formed on the surface of the silicon substrate 100. The insulating layer 114 may be a silicon oxide layer formed by oxidizing the surface of the substrate 100, or the TEOS oxide layer that is coated through deposition. Meanwhile, an oxide layer 115 is also formed on a lower surface of the silicon substrate 100. The insulating layer 114 forms lower walls of the ink chamber 106, the ink channel 105, and the ink feed hole 150, as described later.

Meanwhile, only a part of the silicon wafer is shown in FIG. 8, and the ink-jet printhead according to the present invention is manufactured in several tens through hundreds of chips (head chips) on one wafer.

Next, the heater 108 is formed on the insulating layer 114. An impurity-doped polysilicon layer or a tantalum-aluminum alloy layer is deposited on the insulating layer 114 and patterned in a predetermined shape, thereby forming the heater 108.

Next, although not shown, the electrode to be electrically connected to the heater 108 is formed. The electrode is formed by depositing metals which have a good conductivity, and can be an easily patterned material, i.e., aluminum or aluminum alloy, and patterning the easily patterned material. In this case, a metallic layer forming the electrode is patterned so that an interconnection (not shown) and the bonding pads (101 of FIG. 3) are simultaneously formed another portion of the substrate 100. Meanwhile, a plurality of passivation layers protecting the heater 108 and the electrode may be formed on the insulating layer 114 on which the heater 108 and the electrode are formed.

Figure 9:
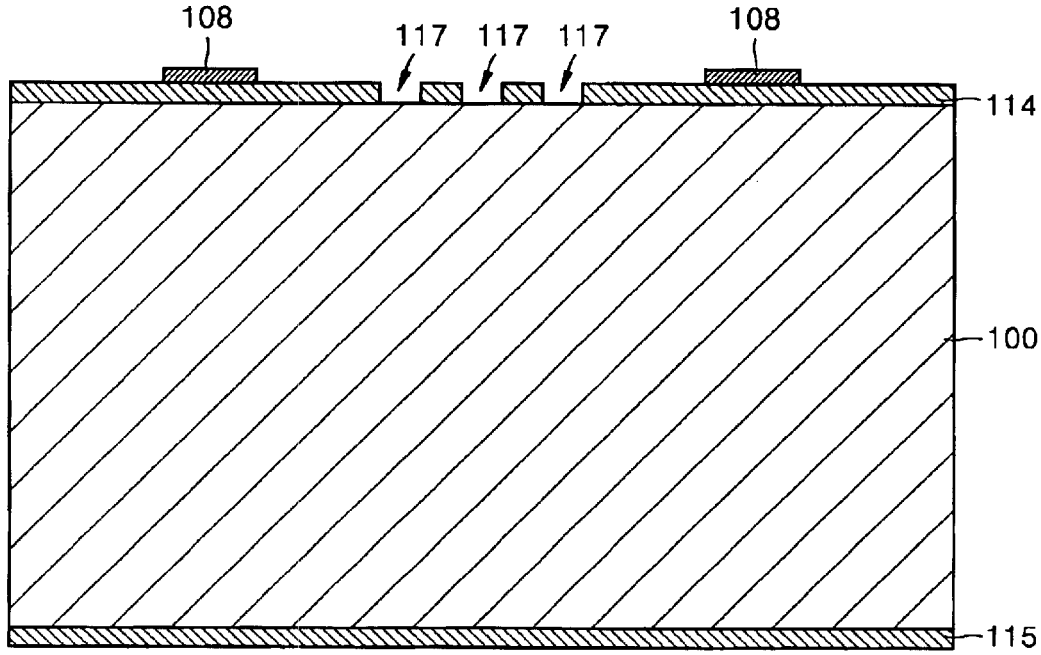

FIG. 9 illustrates a case where a plurality of grooves 117 are formed in the insulating layer 114 formed on the substrate 100.

Specifically, an etch mask which defines a region to be etched on the insulating layer 114, is prepared, and the grooves 117 through which the surface of the substrate 100 is exposed, are formed by etching the insulating layer 114 exposed by the etch mask. The number and arrangement of the grooves 117 may vary with ink ejection characteristics, unlike in FIG. 9.

Figure 10:
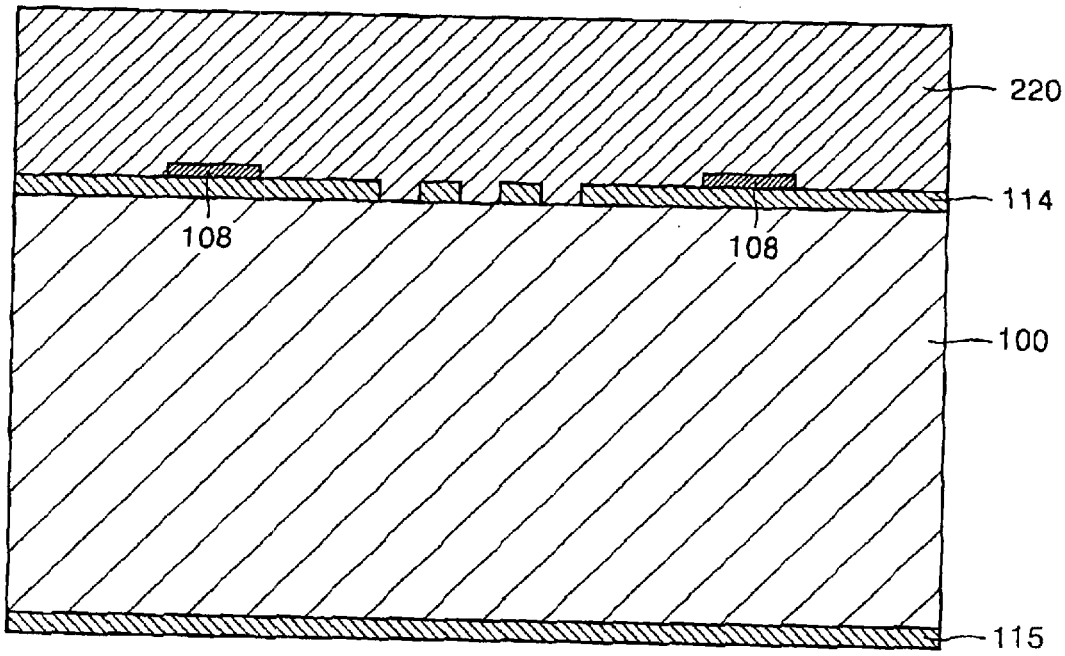

FIG. 10 illustrates a predetermined material layer 220 on the insulating layer 114 in which the grooves 117 are formed. Here, the material layer 220 is formed of photosensitive polyimide.

Figure 11:
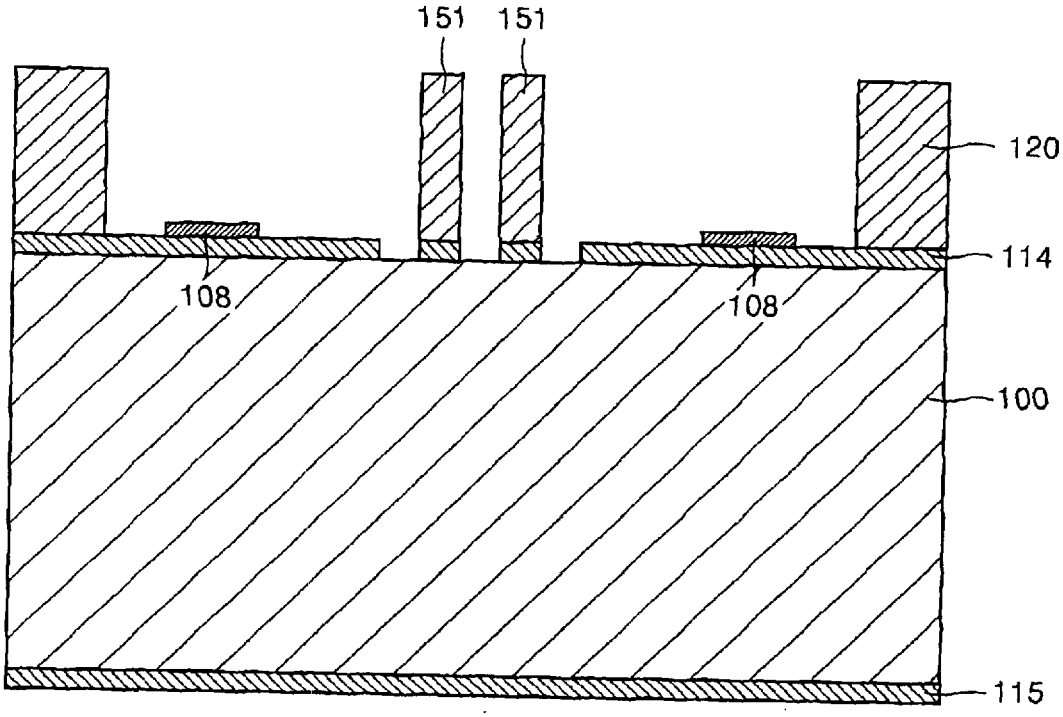

FIG. 11 illustrates a case where the material layer 220 is patterned and the barrier wall 120 and the posts 151 are formed on the insulating layer 114.

Specifically, the material layer 220 formed of photosensitive polyimide is exposed and etched using another etch mask, thereby forming the barrier wall 120 and the posts 151. Here, the number and arrangement of the posts 151 may vary with the ink ejection characteristics, unlike in FIG. 11. The barrier wall 120 defines a space formed between the ink chamber 106, the ink channel 105, and the ink feed hole 150. Also, the posts 151 are formed to the same height as the barrier wall 120. Thus, the posts 151 and the barrier wall 120 support a nozzle plate.

Figure 12:
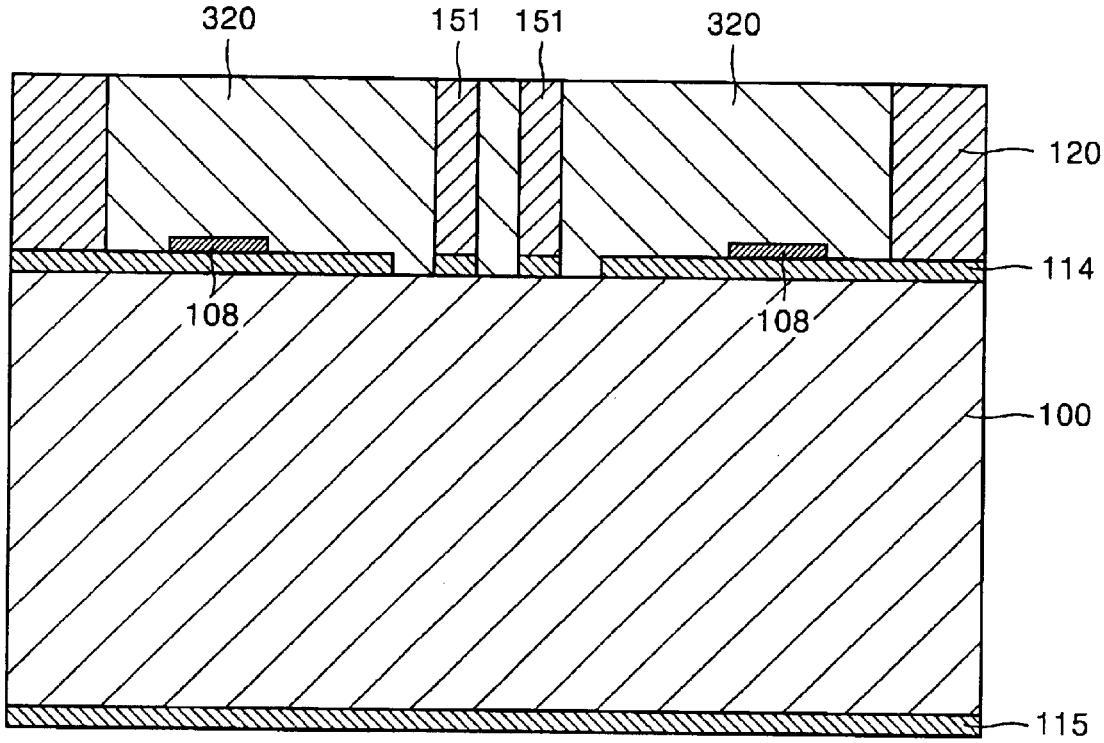

FIG. 12 illustrates a case where a predetermined material layer 320 is formed on the insulating layer 114 in which the barrier wall 120 and the posts 151 are formed and a top surface[s] of the barrier wall 120 and the posts 151 are plained. Here, the material layer 320 is formed of polyimide.

Figure 13:
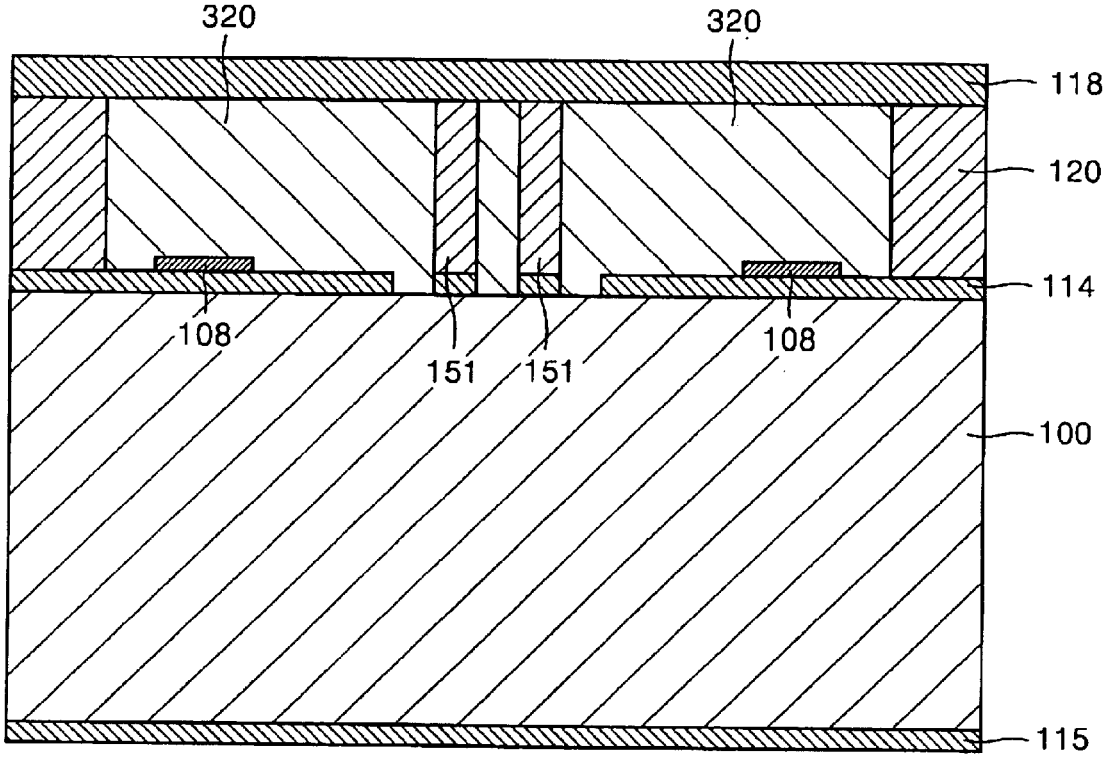

FIG. 13 illustrates a case where the nozzle plate 118 is formed on the top surfaces of the barrier wall 120 and the posts 151 in a state shown in FIG. 12.

The nozzle plate 118 forms upper walls of the ink chamber 106, the ink channel 105, and the ink feed hole 150.

Figure 14:
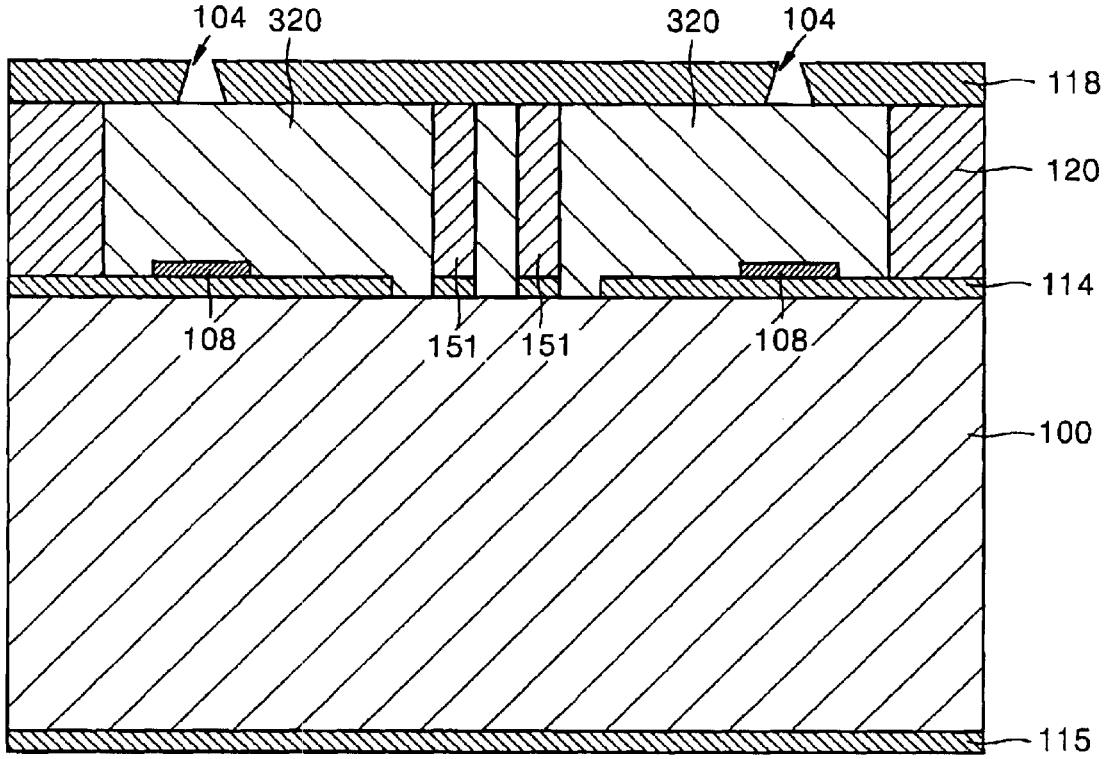

FIG. 14 illustrates a case where the nozzle 104 is formed in the nozzle plate 118. Specifically, the nozzle plate 118 is exposed using another etch mask and etched, thereby forming the nozzle 104 through which the ink is ejected. As a result, a surface of the material layer 320 formed on the insulating layer 114 is exposed through the nozzle 104.

Figure 15:
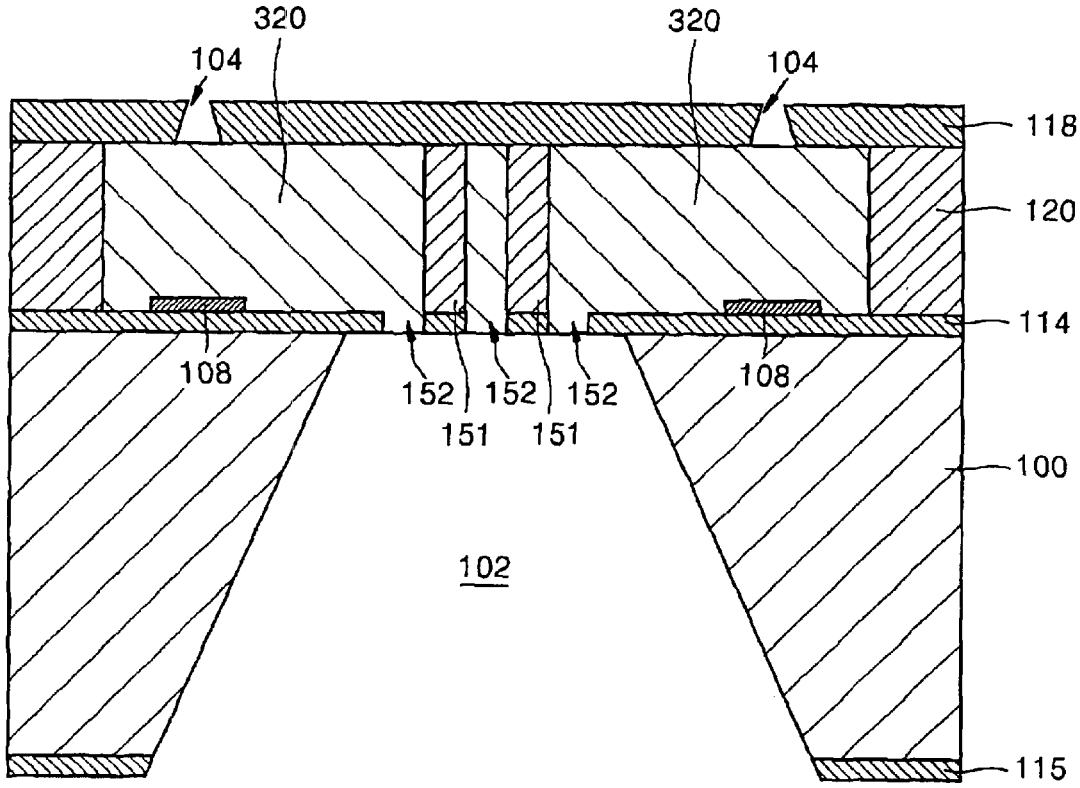

FIG. 15 illustrates a case where the manifold 102 is formed in the substrate 100.

Specifically, the oxide layer formed on the lower surface of the silicon substrate 100 is patterned, thereby forming another etch mask which defines a region to be etched. Subsequently, a wet or dry etch process is performed on the lower surface of the silicon substrate 100 exposed by the etch mask, thereby forming the manifold 102 which perforates the substrate 100. As such, a lower wall of the material layer 320 formed with the above-described grooves (117 of FIG. 8) is exposed through the manifold 102.

Figure 16:
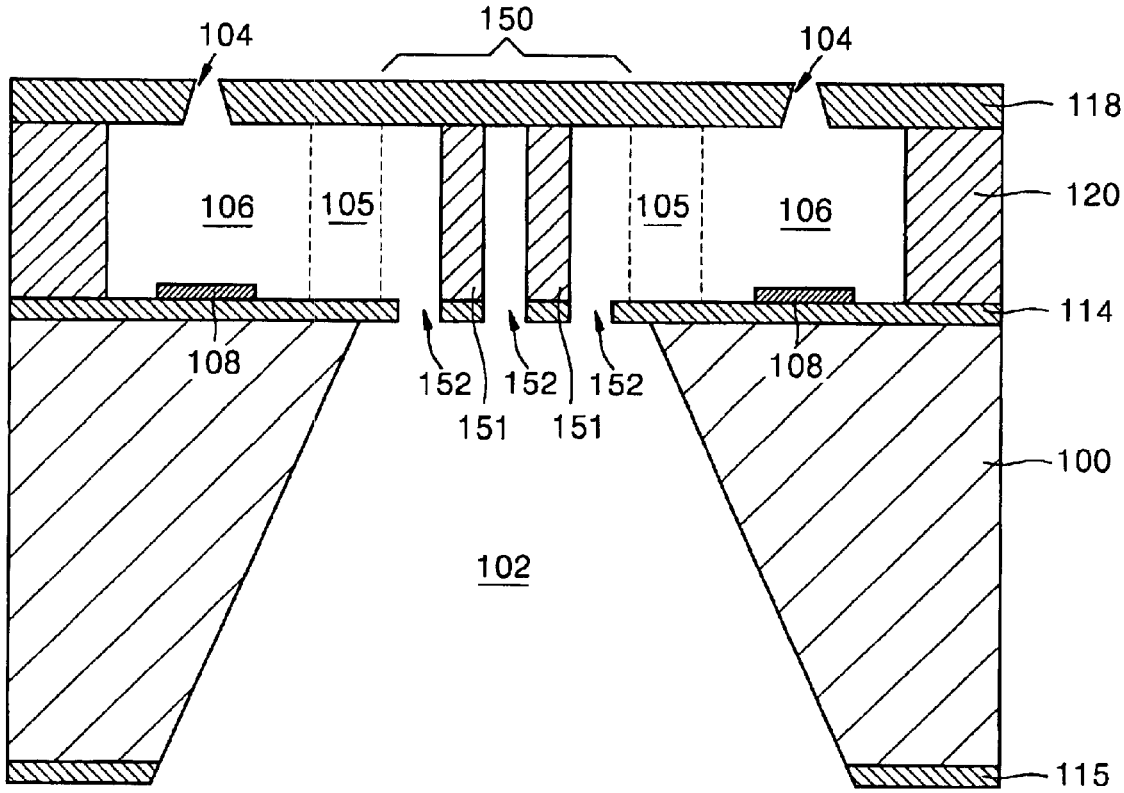

FIG. 16 illustrates a case where the ink chamber 106, the ink channel 105, and the ink feed hole 150 are formed. When the material layer (320 of FIG. 15) exposed through the nozzle 104 and the manifold 102 is etched and removed, the ink chamber 106, the ink channel 105, and the ink feed hole 150 are formed.

Figure 17:
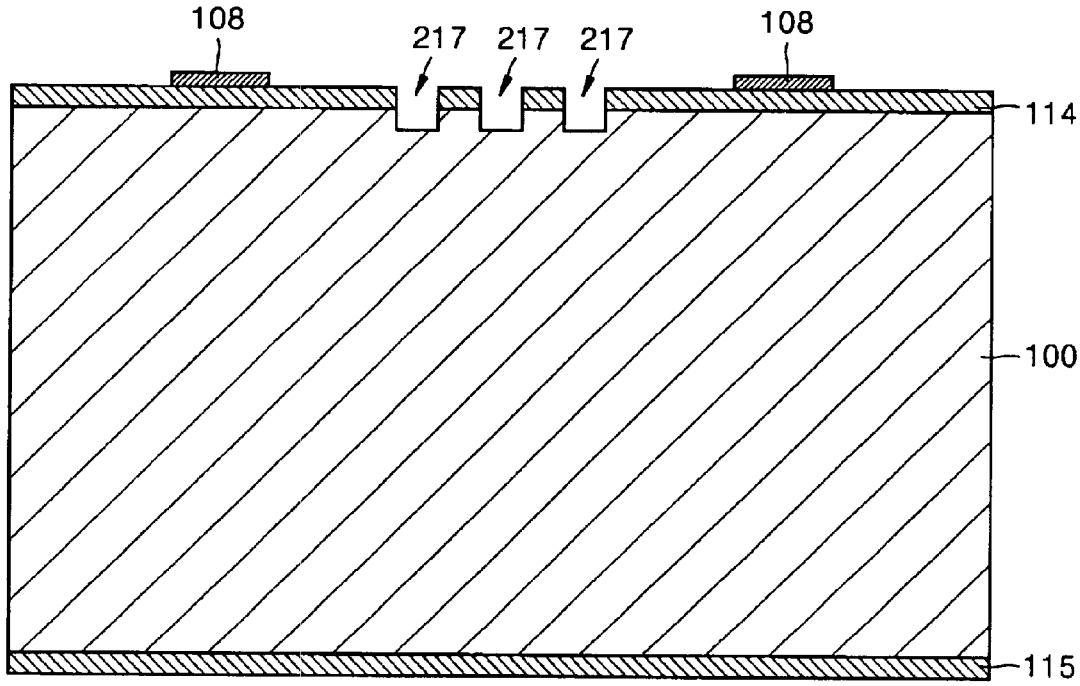
FIG. 17 illustrates a method of manufacturing the ink-jet printhead shown in FIG. 7.

FIG. 17 illustrates a method of manufacturing the ink-jet printhead shown in FIG. 7 and a case where a plurality of grooves 217 are formed to be deeper than the insulating layer 114. Specifically, when the surface of the substrate 100 exposed through the grooves (117 of FIG. 9) in the operation shown in FIG. 9 is etched, the grooves 217 are formed to be deeper than the insulating layer 114. Subsequently, after undergoing the same operations as the above-described operations shown in FIGS. 10 through 15, the ink-jet printhead shown in FIG. 7 is manufactured.

As described above, in the method of manufacturing the ink-jet printhead according to the present invention, the ink-jet printhead is monolithically manufactured such that a process of manufacturing the ink-jet printhead can be simplified and a misalignment which may occur during a process of attaching the nozzle plate to the substrate can be prevented.

Accordingly, other materials may be used for each element of the ink-jet printhead in the present invention. In addition, the above-described method of depositing and forming each material is merely an example, and various deposition and etch methods may be applied in the present invention. In addition, in the method of manufacturing the ink-jet printhead of the present invention, the order of the operations may be changed.

As described above, the method of manufacturing the ink-jet printhead according to the present invention has the following advantages.

First, the ink of which impurities are filtered out through the through hole formed in the insulating layer can be supplied to the ink chamber such that the ink ejection characteristics can be improved. In addition, the cracks which occur on the surface of the substrate can be reduced such that the damage of the head chip can be prevented. Second, the nozzle plate is prevented from being deformed downward by the posts formed in the insulating layer, and the impurities remaining in the ink which passes through the through hole can be filtered once again. Third, the ink-jet printhead is monolithically manufactured such that the process of manufacturing the ink-jet printhead can be simplified.

While this invention has been particularly shown and described with reference to preferred embodiments thereof, it will be understood by those skilled in the art that various changes in form and details may be made therein without departing from the spirit and scope of the invention as defined by the appended claims and their equivalent.

What is claimed is:

1. An ink-jet printhead comprising:

a substrate in which a manifold supplying ink is formed;

a nozzle plate which is formed to be spaced-apart from the substrate by a predetermined gap and in which a nozzle through which ink is ejected is formed;

a barrier wall which seals a space formed between the substrate and the nozzle plate and defines an ink chamber filled with the ink to be ejected, an ink channel connected to the ink chamber, and an ink feed hole connecting the ink channel to the manifold; and an insulating layer which is formed on the substrate and forms lower walls of the ink chamber, the ink channel, and the ink feed hole, where a heater generating bubbles by heating the ink filled in the ink chamber is formed on the lower walls of the ink chamber;

wherein the ink feed hole includes a plurality of through holes which perforate the insulating layer and through which the ink channel is connected to the manifold, and a plurality of posts which are formed on the insulating layer and support the nozzle plate.

2. The printhead of claim 1, wherein the through hole has the same depth as the insulating layer.

3. The printhead of claim 1, wherein the through hole is formed to be deeper than the insulating layer in a direction parallel to an ink ejection direction by etching the insulating layer and the surface of the substrate.

4. The printhead of claim 1, wherein the barrier wall is formed of polyimide.

5. The printhead of claim 1, wherein the posts are formed of polyimide.

6. A method of manufacturing an ink-jet printhead, the method comprising:

forming an insulating layer on a surface of a substrate and forming a heater on the insulating layer;

forming a plurality of grooves having a predetermined depth in the insulating layer;

forming a barrier wall which defines an ink chamber, an ink channel, and an ink feed hole, and a plurality of posts on the insulating layer in which the grooves are formed;

coating a predetermined material on the insulating layer on which the barrier wall and the posts are formed and plaining top surfaces of the barrier wall and the posts;

forming a nozzle plate on the top surfaces of the barrier wall and the posts;

forming a nozzle through which the predetermined material is exposed in the nozzle plate;

forming a manifold through which the predetermined material filled in the grooves is exposed by etching a lower surface of the substrate; and forming the ink chamber, the ink channel, and the ink feed hole by removing the predetermined material exposed through the nozzle and the manifold.

7. The method of claim 6, wherein the forming of the barrier wall comprises:

forming a predetermined material layer on the insulating layer; and patterning the material layer and forming the barrier wall and the posts.

8. The method of claim 7, wherein the material layer is formed of polyimide.

9. An ink-jet printhead comprising:

a substrate having a manifold supplying ink;

a nozzle plate having a nozzle;

a barrier wall formed between the substrate and the nozzle plate to form an ink chamber communicating with the manifold and the nozzle; and a plurality of posts disposed in the ink chamber, formed between the substrate and the nozzle plate, and spaced-apart from each other to support the nozzle plate with respect to the substrate.

10. The printhead of claim 9, wherein the substrate comprises:

a plurality of through holes formed on the substrate to guide ink to flow from the manifold to the ink chamber.

11. The printhead of claim 10, wherein the through holes are disposed between the posts.

12. The printhead of claim 11, wherein the through holes are spaced-apart from each other.

13. The printhead of claim 9, wherein the ink chamber comprises a first portion corresponding to the nozzle and a second portion corresponding the manifold, and the posts are disposed in the second portion of the ink chamber.

14. The printhead of claim 9, wherein the posts are disposed in a direction parallel to an ink ejection direction.

15. The printhead of claim 9, wherein the posts are spaced apart from each other in a direction perpendicular to an ink ejection direction.

16. An ink-jet printhead comprising:

a substrate having a manifold supplying ink;

a nozzle plate having a nozzle;

a barrier wall formed between the substrate and the nozzle plate to form an ink chamber and an ink feed hole portion communicating with corresponding ones of the nozzle and the manifold; and a plurality of posts disposed in the ink chamber, formed between the substrate and the nozzle plate, and spaced-apart from the barrier wall to support the nozzle plate with respect to the substrate.

17. The printhead of claim 16, wherein the barrier wall forms an ink channel between the ink feed hole portion and the ink chamber.

18. The printhead of claim 17, wherein the posts are not disposed in the ink channel and the ink chamber.

19. The printhead of claim 18, wherein the posts have the same height as the barrier wall.

* * * * *